United States Patent [19]

Lief et al.

[11] Patent Number: 4,503,558

[45] Date of Patent: Mar. 5, 1985

[54] INFLATABLE CONTAINER

[75] Inventors: Joseph R. Lief, Lewisville; Michael D. McCully, Dallas, both of Tex.

[73] Assignee: Polar Pouch, Inc., Carrollton, Tex.

[21] Appl. No.: 580,255

[22] Filed: Feb. 15, 1984

[51] Int. Cl.[3] ..... B65D 30/24; B65D 33/14

[52] U.S. Cl. ..... 383;3; 383/13; 383/18

[58] Field of Search ..... 383/3, 13, 18

[56] References Cited

U.S. PATENT DOCUMENTS

| | | | |
|---|---|---|---|
| 1,318,652 | 10/1919 | Farkas . | |
| 2,437,057 | 3/1948 | Waters | 154/42 |
| 2,919,735 | 1/1960 | Prietzsch | 383/13 |
| 3,044,515 | 7/1962 | Eades | 383/3 |
| 3,470,928 | 10/1969 | Schwartz . | |
| 3,587,794 | 6/1971 | Mattel | 383/3 |
| 3,634,970 | 1/1972 | Williams | 47/37 |
| 3,742,994 | 7/1973 | Pensak | 383/3 |
| 3,998,304 | 12/1976 | Edgerton et al. . | |
| 4,044,867 | 8/1977 | Fisher . | |
| 4,164,970 | 8/1979 | Jordan | 383/3 |
| 4,261,448 | 4/1981 | Myers | 383/18 |

*Primary Examiner*—Stephen P. Garbe
*Attorney, Agent, or Firm*—Kenneth R. Glaser

[57] ABSTRACT

An inflatable container having an inflatable peripheral side wall formed by inner·an outer essentially concentric cylindrical members to define an essentially annular thermal insulating inflatable air space. The inflatable container includes two inflatable end walls, each watertight sealed to respective ends of the inflatable peripheral side wall in order to define a closed, watertight cylindrical enclosure. The inflatable container includes along a linear top portion thereof, a zipper mechanism attached to opposed linear edges of the peripheral side wall for permitting access into the cylindrical cavity defined by the container. Proper radial spacing of the inner and outer cylindrical sheets of the peripheral side wall is maintained by a plurality of individual point attachments therebetween which maximize the effective insulating surface area of the side wall, while simultaneously improving the structural rigidity in the linear and transverse directions. The two end pieces of the inflatable container are similarly and individually inflated in order to provide thermal insulation and structural rigidity to the respective end walls. The inflatable container also includes a strap mechanism which is removably attached to respective ends of the cylindrical peripheral side wall in a manner such that the user may carry the inflatable container about by positioning the strap over the user's shoulder.

4 Claims, 7 Drawing Figures

INFLATABLE CONTAINER

BACKGROUND OF THE INVENTION

This invention relates to inflatable containers of flexible sheet material, and more specifically to an inflatable container of the type having a peripheral side wall and two end walls, each designed to provide maximum insulating characteristics.

Heretofore in the field of inflatable containers of this sort, containers have been formed by bonding together a pair of flat resilient sheets in a manner to result in a plurality of parallel elongate inflatable tubes, the parallel tubes being interconnected at one or both ends thereof in a manner to equalize the pressure therein. The resulting structure has sufficient structural rigidity in the axial direction of the elongate tubes, but has essentially no resistance to bending in the direction transverse to the elongate tubes. Additionally, and more importantly, much of the surface area comprises actually the axial bonding strips which bond the two sheets together between the elongate tubes, thereby severely reducing the effective surface area of the thermal insulating surface. Additionally, when a structural container is made from a light weight, flexible material, it becomes difficult to attach a handle or other means for carrying the container thereto because of the areas of concentrated tension and sheer stress on the flexible material at the points of attachment of the handle thereto. To overcome this deficiency, the handles are attached to the flexible material by being axially attached to a rigid structural member positioned on the opposite side (underside) of the flexible material in a manner to dissipate the sheer forces created at the points of connection of the handle to the container. This structural member has the negative effects of adding to the bulkiness and overall weight of the container and more importantly eliminating, or at least severely restricting, the ability of the inflatable container to be folded up into a compact size upon deflation.

Accordingly, it has been considered highly desirable to provide an inflatable container which affords increased thermal insulating surface area between the interior and exterior thereof, while simultaneously providing an improved means for carrying the container which avoids the prior art problems of highly concentrated areas of sheer stress at the points of attachment of a handle to the container.

BRIEF DESCRIPTION OF THE DRAWINGS

Specific features of the invention, as well as additional objects and advantages thereof, will become more readily understood by reference to the following detailed description taken in conjunction with the accompanying drawings, in which like reference numerals refer to corresponding parts, and in which.

and

Figure 7:
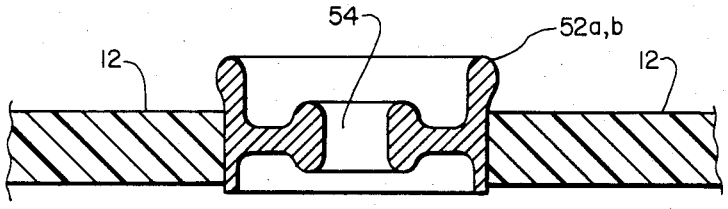

FIG. 7 is a sectional view of the snap mechanism used in attaching the strap loops to the inflatable container.

DETAILED DESCRIPTION OF THE INVENTION

Figure 1:
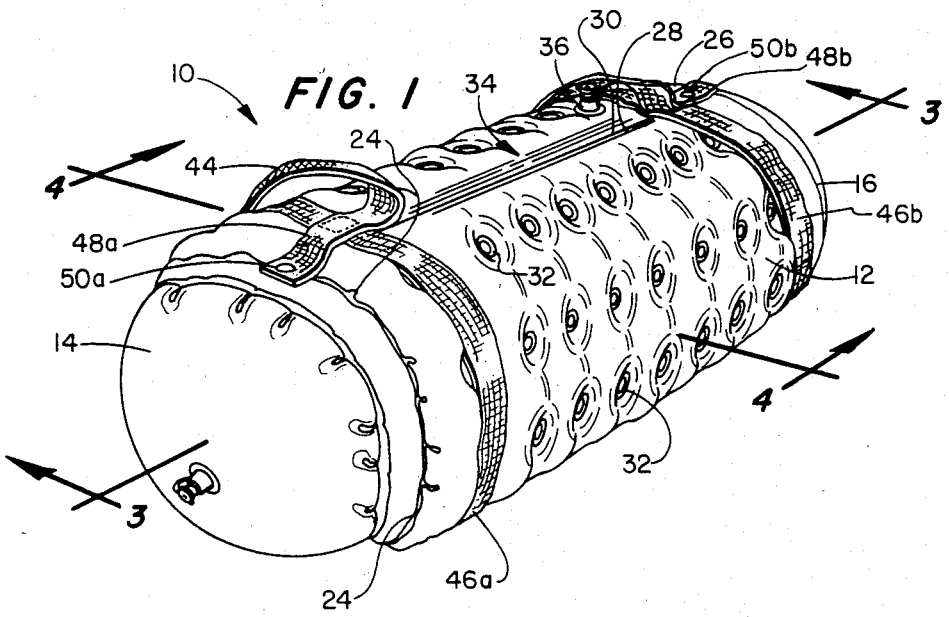
FIG. 1 is a pictorial view of the inflatable container of the present invention.
Figure 4:
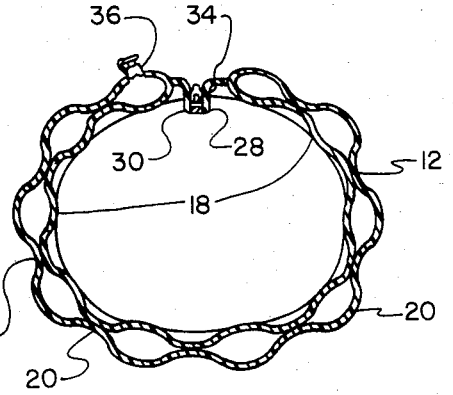
FIG. 4 is a vertical transverse sectional view taken along lines 4—4 shown in FIG. 1.

Turning now to the drawings, and more specifically to FIG. 1, the inflatable container of the present invention is shown generally illustrated by the numeral 10. The container 10 is shown to comprise an inflatable, peripheral side wall 12 formed into a generally cylindrical configuration, and a pair of inflatable end sections 14, 16 bonded to respective ends of the peripheral side wall in a manner to form a watertight essentially cylindrical enclosure. As best shown in FIG. 4, the inflatable peripheral side wall 12 is formed of an inner and an outer sheet of flexible and permeable material 18, 20, respectively. The inner and outer sheets 18, 20 forming the peripheral side wall 12 are basically of identical size and shape, the major difference being that the inner sheet 18 is slightly smaller than the outer sheet 20 in the direction transverse to what will become the axial direction of the inflatable container when the container is formed into a generally cylindrical configuration as shown in FIG. 1. The reason for this is so that the inner and outer sheets of material 18, 20 may be bonded together around their respective peripheries, and result in essentially a cylindrical configuration when inflated.

Figure 6:
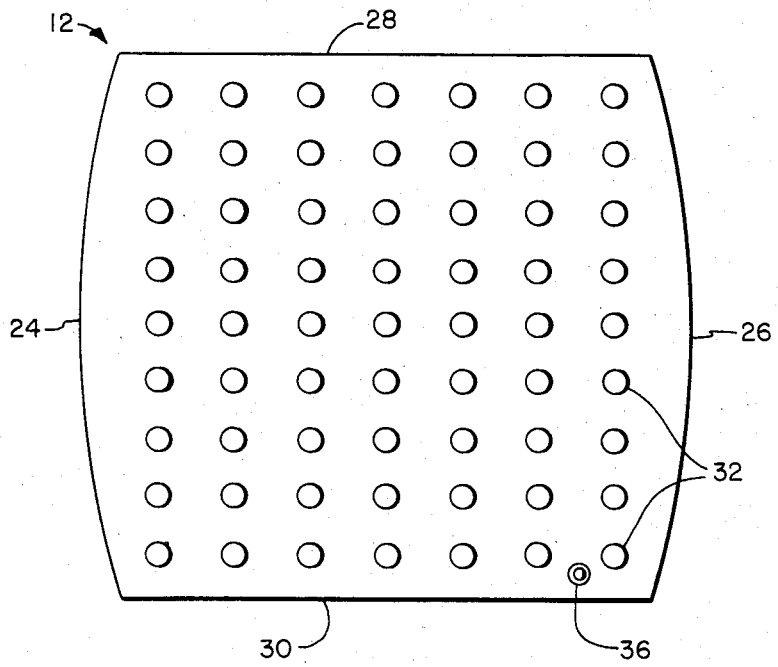
FIG. 6 is a plan view of the peripheral side wall shown in its flattened state subsequent to forming but prior to bonding to the end pieces to form the basically cylindrical container.

Referring to FIG. 6, the peripheral side wall 12 includes a first pair of opposed edges 24, 26 which are of a basic convex configuration when the side wall is in a flattened state prior to being formed into the basically cylindrical configuration, as will be described in greater detail hereinbelow. The peripheral side wall 12 also includes a second pair of opposed edges 28, 30 which are essentially straight and parallel with each other, so that when the second pair of opposed edges are joined together the resulting configuration is basically cylindrical. Additionally, the first pair of opposed edges 24, 26 are oriented such that a line bisecting this first pair of edges is also essentially parallel to the second pair of opposed edges 28, 30 in both the flat, deflated state and the inflated, cylindrical configuration of the peripheral side wall 12.

At the time the peripheral side wall 12 is formed (i.e., when the inner and outer sheets of flexible material 18, 20 are bonded together, customarily by a heating or sonic welding process) the inner and outer sheets are additionally bonded together in a specific pattern of locations which will result in the inner and outer sheets of material being formed into essentially concentric cylinders when the peripheral side wall is inflated. Those skilled in the art will appreciate that the entire periphery of the side wall 12 is sealed air tight in a manner to define a single, inflatable cell having spaced side walls (the inner and outer flexible sheets 18, 20), defining a thermal insulator.

At the same manufacturing step wherein the inner and outer sheets 18, 20 are bonded together around their peripheries to form the peripheral side wall 12, the sheets are also bonded together in a specific pattern across the surface areas thereof in a manner to retain the inner and outer sheets in a specified spaced relation when the peripheral side wall is inflated. The specific bonding pattern is formed by a plurality of selected heat-sealed or sonic welded locations. At each of these locations, the inner and outer sheets are sealed together across a small circular area approximately one-half inch or less in diameter. These individual circular seal spots are referred to in the trade as "buttons" 32. These buttons 32 may be in a square grid pattern, or may be in a pattern of parallel rows in a first direction and staggered or offset in a linear direction normal to the first direction. It has been found that either pattern works sufficiently well to accomplish the desired effect. Specifically, the peripheral side wall 12 serves to (1) provide a maximum insulating surface area (by utilizing minimum areas of bonding the two sheets together wherein no actual thermal insulation is present); (2) maintain the inflated radial distance between the two generally concentric cylinders of material to be as constant as is realistically possible in using fluid pressures against a non-rigid surface; and (3) improve the structural integrity of the device in all directions as opposed to only in a single linear direction.

Figure 3:
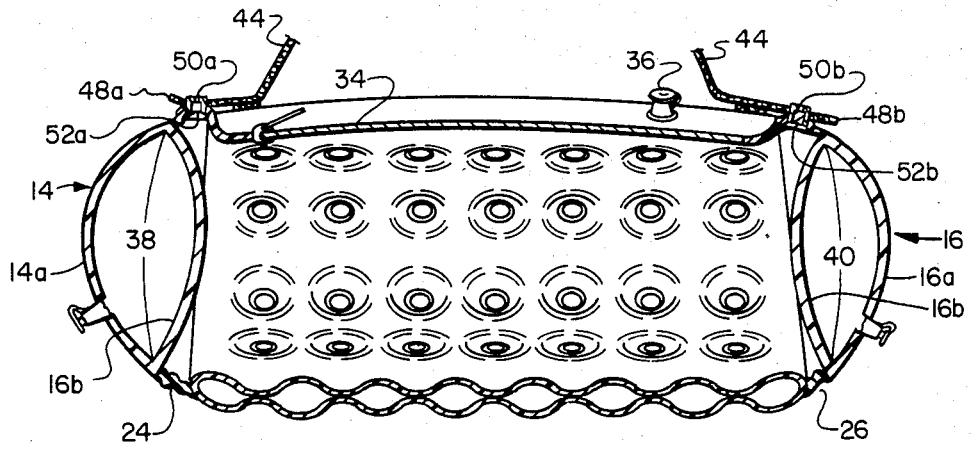
FIG. 3 is a vertical longitudinal sectional view of the inflatable container taken along lines 3—3 shown in FIG. 1.

As shown in FIGS. 1, 3 and 4, the peripheral side wall includes a zipper mechanism 34 bonded to the second pair of the opposite edges 28, 30 of the peripheral side wall in a manner to complete the general cylindrical configuration of the side wall. The zipper mechanism 34 is bonded to the respective opposed edges in a manner to define an access opening into the cylindrical container along essentially the entire length thereof in a manner to provide easy access into the container. The peripheral side wall 12 also includes an air valve 36 for mechanically or orally inflating the peripheral side wall when desired.

The inflatable end sections 14, 16 of the inflatable container 10 of the present invention are bonded to respective ends of the cylindrical, peripheral side wall 12, specifically to respective ones of the first pair of convex opposite edges 24, 26 of the peripheral side wall. As best shown in FIG. 3, each of the inflatable end sections 14, 16 includes respective outer end section sheets 14*a*, 16*a* and inner end section sheets 14*b*, 16*b*. In the embodiment shown, these respective outer and inner sheets are bonded together only around their respective peripheries, 38, 40. This results in a significant ballooning effect of the two end sections when inflated, which actually increases the thermal insulating properties of the respective end sections 14, 16. Alternatively, it should be readily apparent that buttons similar to the buttons 32 in the peripheral side wall may be utilized to maintain the respective inner and outer end section sheets in appropriate spaced relation.

Figure 2:
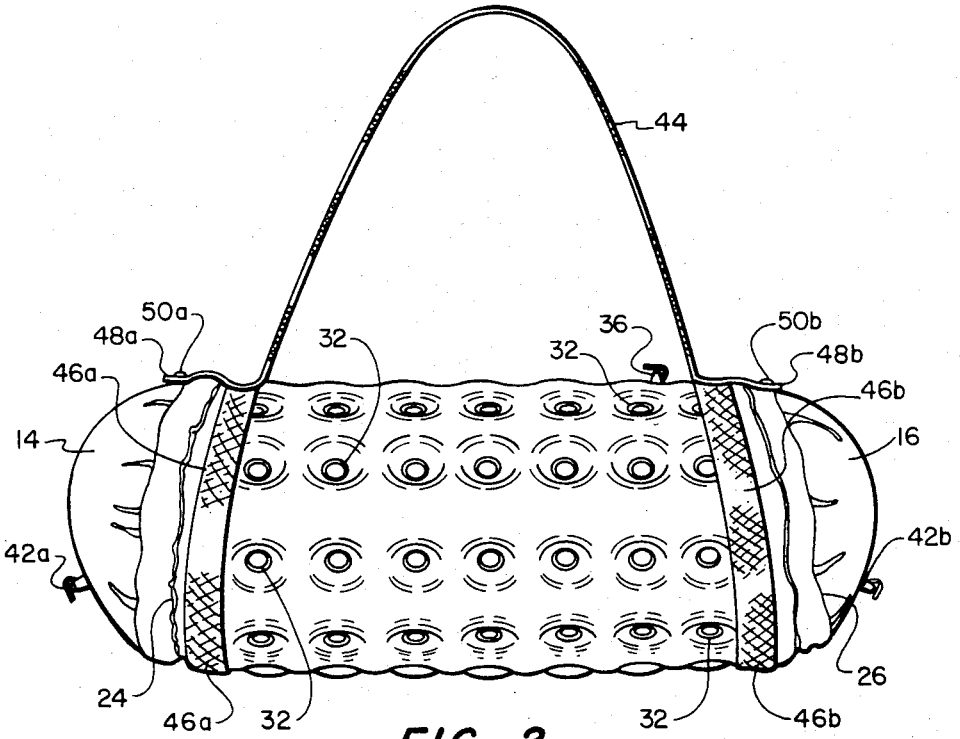
FIG. 2 is a front view of the inflatable container.

As best shown in FIG. 2, the effect of the peripheral side wall first pair of opposte edges 24, 26 being convex in shape will result in the inflatable container being of a trapezoidal shape when viewed from the side. The purpose of this is to lower the effective center of gravity of the inflatable container, and, of course, its contents, in order to prevent the container from toppling over and spilling the contents or otherwise leaking water through the zipper mechanism 34 or through a snap mechanism, which will be described in greater detail hereinbelow. Those skilled in the art will readily appreciate that due to this trapezoidal shape of the inflatable container of the present invention, the respective inflatable end sections 14, 16 are of an oval configuration in order to properly mate with the respective convex edges 24, 26 of the peripheral side wall and form a proper watertight seal therewith. Additionally, of course, each of the inflatable end sections includes an air valve 42*a*, 42*b* to permit the mechanical or oral inflation of the end sections as in the peripheral side wall 12.

The inflatable container 10 of the present invention also includes means for conveniently carrying the container about. As shown in FIG. 2, this carrying means comprises a strap section 44 which is connected at each end thereof to a respective loop section 46*a*, 46*b*, each loop section being adapted to surround a respective end of the container in a manner to conveniently support the container. As shown, the loop sections 46*a*, 46*b* are essentially parallel to the juncture of the peripheral side wall and respective end sections, in order that the line of force of the strap section and respective loop sections be maintained essentially linear.

Figure 5:
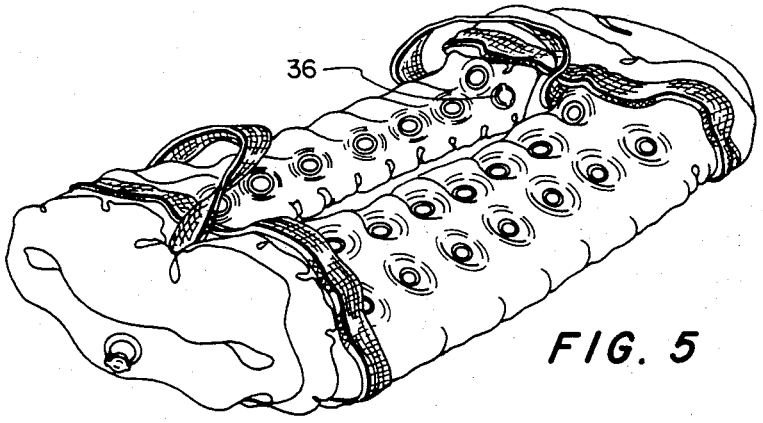
FIG. 5 is a pictorial view of the inflatable container of the present invention shown in its deflated, collapsed state.

The inflatable container also includes means for attaching the strap and loop sections to the container to maintain the strap in a functional position and prevent the strap and loop sections from sliding toward the center of the container, as may otherwise happen but for the attachment means. In the embodiment shown (see FIG. 3), the attachment means takes the form of a tab portion 48*a*, 48*b* of the strap section having a snap mechanism 50*a*, 50*b* affixed thereto which engages a mating snap mechanism 52*a*, 52*b* formed with or otherwise affixed to the inflatable container adjacent respective ends of the zipper mechanism 34. In this manner, the carrying strap 44 may be easily removed from the inflatable container, when desired, and may be removably attached to the inflatable container and retained in place, when it is desired to transport the container, as by positioning the strap 44 over the user's shoulder. Additionally, the snap mechanism 50*a*, 50*b*, 52*a*, 52*b* retains the carrying strap and loop sections in functional position when the inflatable container is in its deflated state, as shown in FIG. 5, to prevent the natural tendency of the loops to slide off of the container when deflated to a smaller size.

Referring to FIG. 7, a further advantage of utilizing the particular snap mechanism to attach the strap and loop sections to the inflatable container is that the particular snap mechanism used includes a through passageway 54 interconnecting the interior of the container with the container exterior. In this manner, water (melted ice) that has collected in the container may be easily removed by turning the inflated container upside down (the zipper remaining closed to prevent a sudden rush of water) to permit the water to drain therefrom in a controlled manner through the passageways 54 formed in the snap mechanisms.

Although a preferred embodiment of an inflatable container in accordance with the present invention has been described in detail, it should be understood that various substitutions, alternatives and modifications may become apparent to those skilled in the art. These changes may be made without departing from the spirit and scope of the invention as defined by the appended claims.

What is claimed is:

1. An inflatable container comprising:

(a) an inflatable, peripheral side wall formed of two sheets of flexible and impermeable material bonded together at selected locations thereof to define a single, inflatable cell having spaced side walls comprising essentially concentric cylinders, said side walls having a first pair of opposed edges, said first pair of opposed edges being convex when said peripheral side wall is in a deflated state prior to being formed into a cylindrical shape, and a second pair of opposed edges, said second pair of opposed edges being essentially parallel to each other and essentially parallel to a line bisecting said first pair of opposed edges;

(b) a pair of inflatable end portions, each of said end portions being bonded to respective ones of said first pair of opposed edges of said side wall to define a closed water tight cylindrical container, said inflatable end portions being essentially oval to effect a proper seal with respective ones of said first pair of opposed edges at each end of said container, said inflatable end portions being inflatable throughout essentially the entire respective surface areas thereof;

(c) closure means bonded to said peripheral side wall second pair of opposed edges in a manner to form said side wall into essentially a cylindrical container, said closure means defining an access opening in said container into the interior of said container, said closure means comprising a zipper mechanism;

and (d) carrying means comprising a pair of closed loop sections adapted to surround respective ends of said container adjacent respective ones of said first pair of opposed edges of said side wall to thereby support said container, an elongate strap section interconnecting said pair of closed loop sections adjacent respective ends of said zipper mechanism, and attachment means for removably attaching said carrying means to said container.

2. The container as set forth in claim 1, wherein said attachment means comprises mating, snap mechanisms positioned adjacent respective end portions of said container.

3. The container as set forth in claim 1, wherein said peripheral side wall is bonded together at selected locations by sealing said side wall together in a pattern of small, circular bonded sections.

4. The container as set forth in claim 1, wherein said attachment means defines a passageway interconnecting the interior of said container with the exterior thereof.

* * * * *